US010974210B2

(12) United States Patent
Hay

(10) Patent No.: US 10,974,210 B2
(45) Date of Patent: Apr. 13, 2021

(54) SELF-CARBONATING BEVERAGE CONTAINER

(71) Applicant: Dror Hay, Beer Sheva (IL)

(72) Inventor: Dror Hay, Beer Sheva (IL)

( * ) Notice: Subject to any disclaimer, the term of this patent is extended or adjusted under 35 U.S.C. 154(b) by 0 days.

(21) Appl. No.: 16/472,504

(22) PCT Filed: Dec. 26, 2017

(86) PCT No.: PCT/IL2017/051386
§ 371 (c)(1),
(2) Date: Jun. 21, 2019

(87) PCT Pub. No.: WO2018/122840
PCT Pub. Date: Jul. 5, 2018

(65) Prior Publication Data

US 2020/0188866 A1 Jun. 18, 2020

(30) Foreign Application Priority Data

Dec. 26, 2016 (IL) ..... 249778

(51) Int. Cl.
*B01F 3/04* (2006.01)
*B65D 8/00* (2006.01)
(Continued)

(52) U.S. Cl.
CPC ..... *B01F 3/04794* (2013.01); *B01F 15/0206* (2013.01); *B65D 7/04* (2013.01);
(Continued)

(58) Field of Classification Search
CPC ..... B01F 3/04794; B01F 15/0206; B01F 2003/049; B01F 2215/0022; B65D 7/04; B65D 51/2821; B65D 85/73
(Continued)

(56) References Cited

U.S. PATENT DOCUMENTS 2,336,708 A * 12/1943 Ward ..... B01F 13/0033 261/121.1
2,694,506 A * 11/1954 Knapp ..... B01F 3/04801 222/5
(Continued)

FOREIGN PATENT DOCUMENTS

JP 61-185322 A 8/1986

OTHER PUBLICATIONS

International Search Report for PCT/IL2017/051386 dated Mar. 26, 2018.
Written Opinion for PCT/IL2017/051386 dated Mar. 26, 2018.

*Primary Examiner* — Charles S Bushey
(74) *Attorney, Agent, or Firm* — FisherBroyles, LLP; Robert Kinberg

(57) ABSTRACT

A self-carbonating beverage container includes a beverage can housing adapted to hold a fixed portion of liquid. A carbonating gas bottle containing carbonating gas stored under pressure has a breakable seal through which the carbonating gas is released. The carbonating gas bottle is attached to the can. A spout is attached to the can such that one end of the spout is introduced into the beverage can housing and the other end of the spout has a puncturing mechanism facing the breakable seal of the carbonating gas bottle. Actuating the puncturing mechanism enables the carbonating gas to flow into the beverage can housing.

4 Claims, 4 Drawing Sheets

(51) Int. Cl.
*B65D 51/28* (2006.01)
*B01F 15/02* (2006.01)
*B65D 85/73* (2006.01)

(52) U.S. Cl.
CPC ..... *B65D 51/2821* (2013.01); *B65D 85/73* (2013.01); *B01F 2003/049* (2013.01); *B01F 2215/0022* (2013.01)

(58) Field of Classification Search
USPC ..... 261/74, 77, DIG. 7
See application file for complete search history.

(56) References Cited

U.S. PATENT DOCUMENTS 2,805,846 A * 9/1957 Dewan ..... B01F 3/04801 261/121.1
4,323,171 A * 4/1982 Whorton, III ..... B67D 1/0079 222/180
4,457,877 A * 7/1984 Love ..... B01F 3/04 261/64.3
4,526,730 A * 7/1985 Cochran ..... B01F 3/04801 141/17
5,180,081 A * 1/1993 McCann ..... B67D 1/0418 222/23
5,329,975 A * 7/1994 Heitel ..... B65D 83/42 141/19
6,076,570 A * 6/2000 Byrne ..... B65D 85/73 141/100
6,412,668 B1 7/2002 Vlooswijk et al.
6,708,844 B2 3/2004 Lim et al.
9,205,387 B2 * 12/2015 Bueno ..... B01F 3/04801
2013/0113124 A1 * 5/2013 Hoffmann ..... A23L 2/54 261/65

* cited by examiner

SELF-CARBONATING BEVERAGE CONTAINER

FIELD OF THE INVENTION

The present invention relates to the field of beverage containers. More particularly, the invention relates to a self-carbonating beverage container such as a common beverage can.

BACKGROUND

Beverage containers such as a common beverage can with a pop-open tab are well known in the art. Such a beverage can is a metal container designed to hold a fixed portion of liquid such as carbonated soft drinks, alcoholic beverages, fruit juices, teas, herbal teas, energy drinks, etc. Usually, beverage cans are made of aluminum or tin-plated steel. Even though most of the abovementioned containers provide enough sealing to prevent the carbonating gas from leaking the carbonated liquid rapidly became flat from gas after the can is opened.

In many cases the absorptive degree of the carbonating gas and a major part of the beverage flavor are correlated. Thus, after opening a beverage can the flavor of the beverage rapidly changes and losses its original flavor. Accordingly, there is a need for a self-carbonating drinking can which can carbonate a beverage on demand and thus, preserving the beverage original flavor.

Additionally, many alcoholic beverages comprise carbonating gas as essential ingredient of their flavor. In most cases these alcoholic beverages are usually poured and mixed by a bartender or the like before being served to the ordering client. In many cases there is a substantial time gap between the ordering and the actual drinking of the alcoholic beverages. Accordingly, there is a need for a self-carbonating drinking can which can carbonate a beverage on demand, by the ordering client, right before the drinking and thus, preserving the beverage original flavor.

U.S. Pat. No. 6,708,844 discloses a gas storage and delivery system for replacing gas lost from a pressurized container or a carbonated beverage, or for introducing a gas such as oxygen into a beverage such as bottled water or a sports drink. The system uses material that is capable of adsorption and storage of large quantities of gas and then to release them under predetermined conditions. However, the system of U.S. Pat. No. 6,708,844 is designed to release gas in a moderate paste, thus, it fails to carbonate the beverage on demand, by the ordering client, right before the drinking, and thus, preserving the beverage original flavor.

It is an object of the present invention to provide a self-carbonating beverage can which can carbonate a beverage on demand, by the ordering client, right before the drinking and thus, preserving the beverage original flavor.

SUMMARY OF THE INVENTION

The present invention relates to a self-carbonating beverage container, comprising: a) beverage can housing adapted to hold a fixed portion of liquid; b) a carbonating gas bottle containing carbonating gas stored under pressure having a breakable seal through which said carbonating gas is released, wherein said carbonating gas bottle is attached to said can; and c) a spout attached to said can such that one end of said spout is introduced into the beverage can housing and the spout other end comprises puncturing means and it faces the breakable seal of said carbonating gas bottle, wherein actuating said puncturing means enables the carbonating gas to flow into the beverage can housing According to an embodiment of the invention, the beverage can housing includes a side wall portion, a can base and a detachable can top having an upper part and a lower part, wherein the carbonating gas bottle is attached to said can top upper part by a fastener such that the breakable seal is facing in a horizontal manner.

According to an embodiment of the invention, the spout attached to the can top lower part by a fastener such that one end of said spout is introduced into the beverage can housing and the spout other end that comprises the puncturing means is fastened firmly to the can top lower part such that said puncturing means is facing the breakable seal.

According to an embodiment of the invention, the detachable can top upper part and lower part comprises engagement means which can engage said upper part and lower part by rotational movement such that said rotational movement actuates said puncturing means to further puncture the breakable seal while engaging the carbonating gas bottle with the spout end facing said seal to enable the carbonating gas to flow into the beverage can housing.

According to an embodiment of the invention, the puncturing means is actuated by a press-button mechanism that enables to apply pressure on the breakable seal.

In another aspect, the present invention relates to a self-carbonating beverage container comprising: a) a beverage can housing including a side wall portion, a can base and a detachable can top having an upper part and a lower part; b) a carbonating gas bottle containing carbonating gas stored under pressure having a bottle top with a breakable seal through which said carbonating gas is released, wherein said carbonating gas bottle is attached to said can top upper part by a fastener such that said breakable seal is facing in a horizontal manner; and c) a spout attached to said can top lower part by a fastener such that one end of said spout is introduced into the beverage can housing and the spout other end comprises puncturing means and is fastened firmly to said can top lower part such that said puncturing means is facing said breakable seal, wherein said detachable can top upper part and lower part comprises engagement means which can engage said upper part and lower part by rotational movement such that said rotational movement further puncture said breakable seal while engaging the carbonating gas bottle with said spout end facing said seal to enable the carbonating gas to flow into the beverage can housing.

According to an embodiment of the invention, the carbonating gas bottle contains a gaseous material, such as carbon dioxide.

BRIEF DESCRIPTION OF THE DRAWINGS

The present invention will be understood and appreciated from the following detailed description, taken in conjunction with the drawings in which.

DETAILED DESCRIPTION OF THE INVENTION

Throughout this description the term "beverage can" is used to indicate an essentially vertical container adapted to hold a fixed portion of liquid such as soft drinks, alcoholic beverages, fruit juices, energy drinks, etc. This term does not imply any particular shape, construction material (e.g., aluminum or tin-plated steel) or geometry, and invention is applicable to all suitable liquid containers.

Reference will now be made to several embodiments of the present invention, examples of which are illustrated in the accompanying figures. Wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

Figure 1:
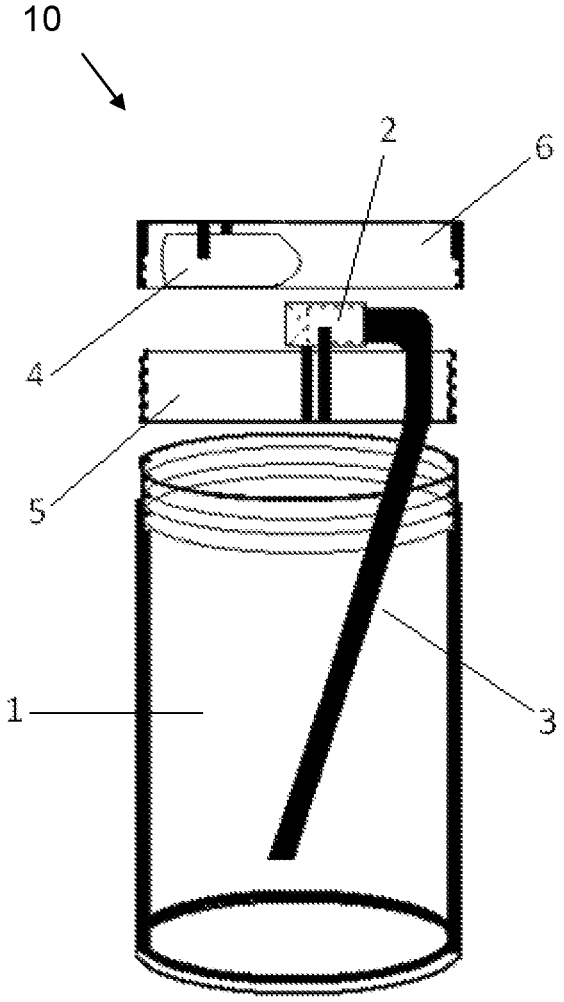
FIG. 1 schematically illustrates an exploded side view of a self-carbonating beverage can, constructed and operative in accordance with an embodiment of the present invention.

FIG. 1 schematically illustrates an exploded-view of a self-carbonating beverage can 10, according to an embodiment of the invention. Beverage can 10 comprises a detachable can top having an upper part 6 and a lower part 5, a housing 1 defining a filling cavity filled with a liquid substance, a carbonating gas bottle 4 that may store pressurized carbon dioxide, and a spout 3.

This exploded-view may also refer to the beverage can 10 in a disassembled state where the detachable can top is separated from the can housing 1 and the upper part 6 and the lower part 5 of the detachable can top are separated from each other. Carbonating gas bottle 4, containing carbonating gas stored under pressure, having a bottle top with a breakable seal through which the carbonating gas is released into the liquid beverage, is attached to the can top upper part 6 by a fastener such that the breakable seal is facing in a horizontal manner. Spout 3 is attached to the can top lower part 5 by a fastener such that one end of spout 3 is introduced into the beverage can housing 1 and the spout other end comprises a puncturing means 2 and is fastened firmly to the can top lower part 5 such that the puncturing means 2 is facing the breakable seal. According to this embodiment, the detachable can top upper part 6 and lower part 5 comprises engagement means which can engage the upper part 6 and lower part 5 by rotational movement such that the rotational movement further puncture the breakable seal while engaging the carbonating gas bottle 4 with the spout end facing the seal to enable the carbonating gas to flow into the beverage can housing 1. According to other embodiments of the present invention, the breakable seal can be opened or punctured by other suitable techniques or puncturing means. For example, by using a mechanism adapted to open the breakable seal by applying pressure on the seal, such as a pressing button or similar mechanism that can be operated to apply pressure on the seal.

Figure 2:
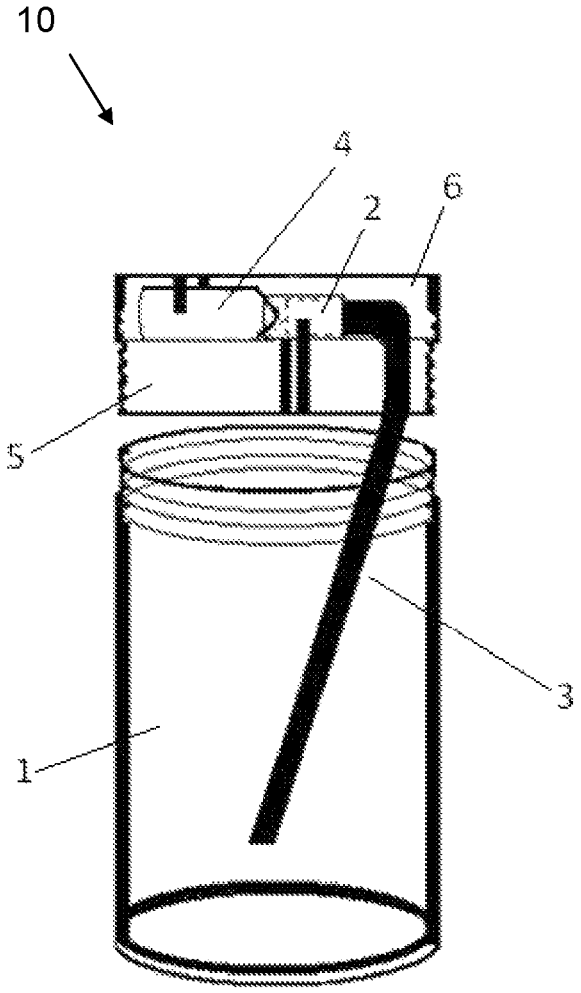
FIG. 2 schematically illustrates the self-carbonating beverage can where the detachable can top is separated from the can housing and the upper part and the lower part of the detachable can top are attached to each other, constructed and operative in accordance with an embodiment of the present invention.

FIG. 2 is a simplified side view pictorial illustration of the self-carbonating beverage can 10 in an open position where the detachable can top is separated from the can housing 1 and the upper part 6 and the lower part 5 of the detachable can top are engaged, constructed and operative in accordance with an embodiment of the present invention.

Figure 3:
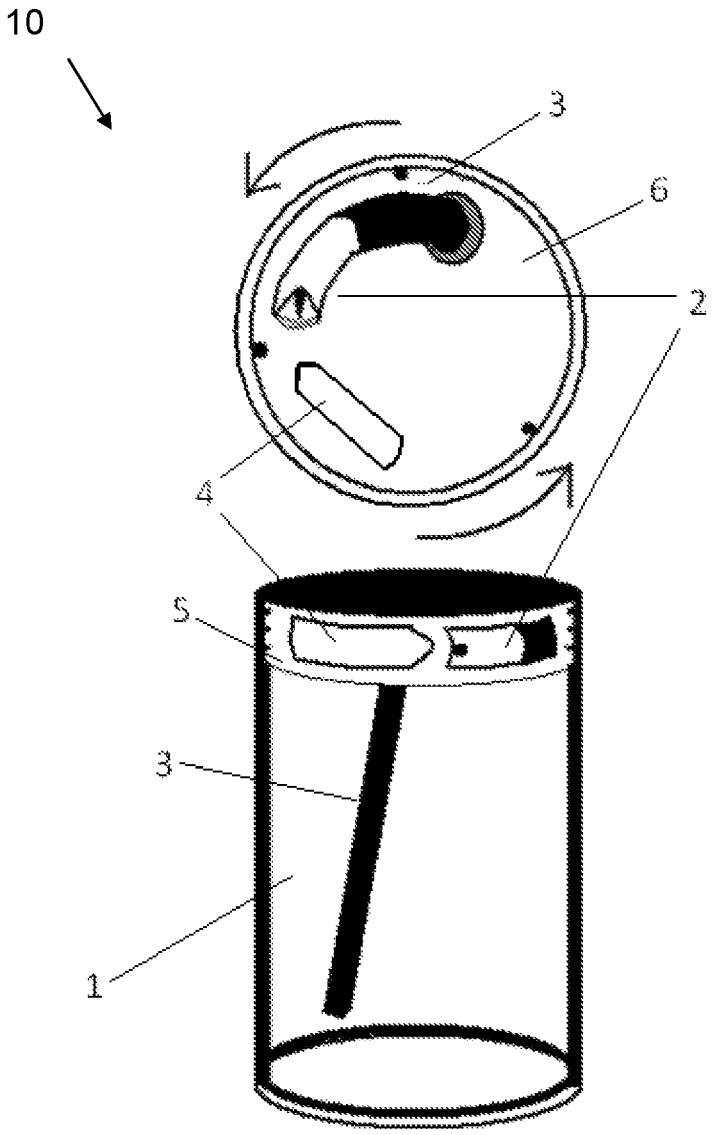
FIG. 3 schematically illustrates a lower-view of the engagement means which can engage the upper part and the lower part of the self-carbonating beverage can by rotational movement, constructed and operative in accordance with an embodiment of the present invention.

The basic combination of the engagement means which can engage the upper part 6 and the lower part 5 of the self-carbonating beverage can 10 by rotational movement is disclosed in FIG. 3. The abovementioned rotational movement further punctures the breakable seal of carbonated gas bottle 4 while engaging the carbonating gas bottle 4 with the end of spout 3 facing the seal to enable the carbonating gas to flow into the housing 1 of beverage can 10.

Figure 4:
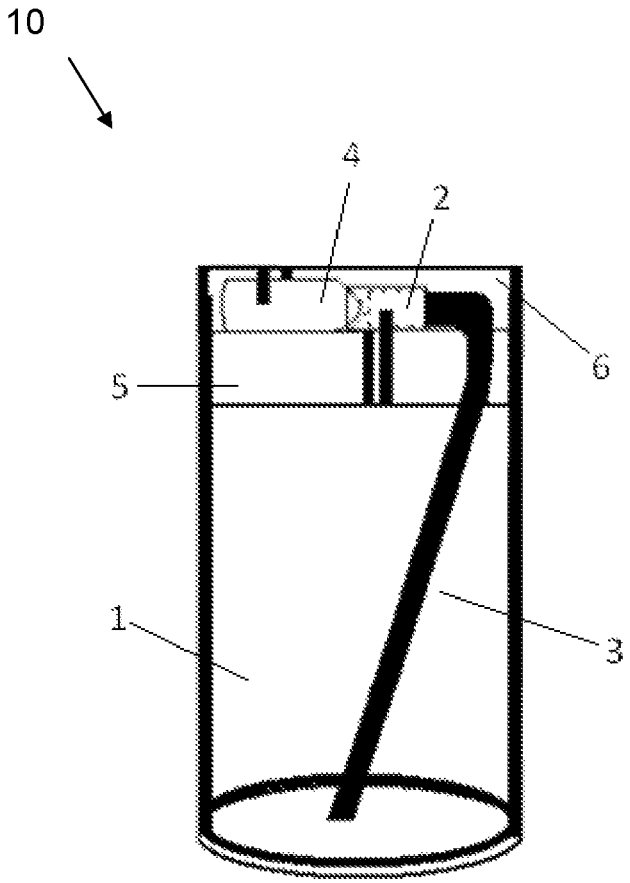
FIG. 4 schematically illustrates the self-carbonating drinking can in a closed position where the detachable can top is attached to the can housing and the upper part and the lower part of the detachable can top are attached to each other, constructed and operative in accordance with an embodiment of the present invention.

Reference is now made to FIG. 4 which is a simplified side view pictorial illustration of the self-carbonating beverage can 10 in a closed position where the detachable can top is attached to the can housing 1 and the upper part 6 and the lower part 5 of the detachable can top are attached to each other such that the end of spout 3 facing the seal of the carbonating gas bottle 4 punctures the breakable seal while engaging the carbonating gas bottle 4 with the end of spout 3 facing the seal to enable the carbonating gas to flow into the housing 1 of beverage can 10, constructed and operative in accordance with an embodiment of the present invention.

Although embodiments of the present invention have been described by way of illustration, it will be understood that the invention may be carried out with many variations, modifications, and adaptations, without departing from the scope of the claims.

The embodiments described above are to be considered in all aspects as illustrative only and not restrictive in any manner. Thus, other system architectures, platforms, and implementations that can support various aspects of the invention may be utilized without departing from the essential characteristics as described herein. These and various other adaptations and combination of features of the embodiments disclosed are within the scope of the invention. The invention is defined by the claims and their full scope of equivalents.

The invention claimed is:

1. A self-carbonating beverage can, comprising:

a) a beverage can housing adapted to hold a fixed portion of liquid, wherein the beverage can housing includes a side wall portion having a central axis, a can base attached to a bottom of the side wall and a can top having a can top lower part detachably connected to a top of the side wall and a can top upper part arranged to be rotatable relative to the can top lower part;

b) a carbonating gas bottle containing carbonating gas stored under pressure having a breakable seal through which said carbonating gas is releasable, wherein said carbonating gas bottle is attached to said can top upper part by a fastener; and c) a spout attached to the can top lower part by a fastener such when the can top lower part is attached to the top of the side wall portion, one end of said spout extends into the beverage can housing and the spout other end comprises a puncturing means fastened firmly to the can top lower part;

wherein when the can top is attached to the beverage can housing in an upright position, the puncturing means is positioned outside the central axis and the carbonating gas bottle is fixed in a horizontal position completely outside the central axis with the breakable seal facing toward the puncturing means in a horizontal direction such that, when the can top upper part is rotated relative to the can top lower part, the puncturing means engages the breakable seal of the carbonating gas bottle in the horizontal direction outside the central axis.

2. The self-carbonating beverage container according to claim 1, wherein the can top upper part is sufficiently rotatable relative to the can top lower part to cause the puncturing means to puncture the breakable seal to enable the carbonating gas to flow into the beverage can housing.

3. The self-carbonating beverage container according to claim 1, wherein the carbonating gas is carbon dioxide.

4. The self-carbonating beverage container according to claim 1, further including a press-button which can be actuated for causing the puncturing means to apply pressure on the breakable seal.

* * * * *